US006952154B2

(12) United States Patent
Almgren et al.

(10) Patent No.: US 6,952,154 B2
(45) Date of Patent: Oct. 4, 2005

(54) COMPOSITE INSULATOR FOR FUSE CUTOUT

(75) Inventors: Victor Almgren, Chicago, IL (US); Scott Henricks, Prairie Grove, IL (US); Michael J. Schomer, Mount Prospect, IL (US)

(73) Assignee: MacLean-Fogg Company, Mundelein, IL (US)

( * ) Notice: Subject to any disclaimer, the term of this patent is extended or adjusted under 35 U.S.C. 154(b) by 126 days.

(21) Appl. No.: 10/173,386

(22) Filed: Jun. 16, 2002

(65) Prior Publication Data

US 2003/0231097 A1 Dec. 18, 2003

(51) Int. Cl.[7] ..... H01H 85/17; H01H 85/042

(52) U.S. Cl. ..... 337/202; 337/187; 337/246; 337/171

(58) Field of Search ..... 337/171–179, 337/186, 187, 202, 228, 246

(56) References Cited

U.S. PATENT DOCUMENTS

| | | | | | |
|---|---|---|---|---|---|
| 1,691,330 | A | | 11/1928 | Austin | |
| 2,776,332 | A | | 1/1957 | von Cron | |
| 2,961,518 | A | | 11/1960 | Hermann | |
| 3,249,719 | A | | 5/1966 | Misare et al. | |
| 3,522,366 | A | | 7/1970 | Lambeth | |
| 3,594,676 | A | | 7/1971 | Misare | |
| 3,808,352 | A | * | 4/1974 | Johnson | 174/73.1 |
| 3,868,615 | A | | 2/1975 | Haubein et al. | |
| 3,898,372 | A | * | 8/1975 | Kalb | 174/179 |
| 3,952,848 | A | | 4/1976 | Walker et al. | |
| 4,053,707 | A | | 10/1977 | Ely et al. | |
| 4,198,538 | A | | 4/1980 | Lusk | |
| 4,212,696 | A | | 7/1980 | Lusk et al. | |
| 4,217,466 | A | * | 8/1980 | Kuhl | 174/209 |
| 4,246,696 | A | | 1/1981 | Bauer et al. | |
| 4,267,402 | A | | 5/1981 | Reighter | |
| 4,296,276 | A | * | 10/1981 | Ishihara et al. | 174/179 |
| 4,331,833 | A | | 5/1982 | Pargamin et al. | |
| 4,373,113 | A | * | 2/1983 | Winkler et al. | 174/179 |
| 4,386,250 | A | | 5/1983 | Nicoloso | |
| 4,390,745 | A | | 6/1983 | Bottcher et al. | |
| 4,440,975 | A | | 4/1984 | Kaczerginski | |
| 4,540,968 | A | | 9/1985 | Kato et al. | |
| 4,546,341 | A | | 10/1985 | McNaghten et al. | |
| 4,609,798 | A | | 9/1986 | Nicoloso | |
| 4,710,847 | A | | 12/1987 | Kortschinski et al. | |
| 4,714,800 | A | | 12/1987 | Atkins et al. | |
| 4,774,488 | A | | 9/1988 | Field | |
| 4,833,278 | A | | 5/1989 | Lambeth | |
| 4,870,387 | A | | 9/1989 | Harmon | |
| 5,128,648 | A | | 7/1992 | Brandi | |
| 5,220,134 | A | * | 6/1993 | Novel et al. | 174/179 |
| 5,233,132 | A | * | 8/1993 | Soucille | 174/179 |
| 5,300,912 | A | | 4/1994 | Tillery et al. | |
| 5,374,780 | A | * | 12/1994 | Pazdirek | 174/176 |
| 5,389,742 | A | * | 2/1995 | Clabburn et al. | 174/209 |
| 5,406,033 | A | * | 4/1995 | Pazdirek | 174/176 |
| 5,540,991 | A | * | 7/1996 | Hayakawa et al. | 428/370 |
| 5,563,379 | A | * | 10/1996 | Kunieda et al. | 174/169 |
| 5,633,478 | A | * | 5/1997 | Ishino | 174/179 |
| 5,877,453 | A | * | 3/1999 | Hill | 174/179 |
| 5,925,855 | A | * | 7/1999 | Denndorfer | 174/179 |
| 5,945,636 | A | * | 8/1999 | Sakich et al. | 174/174 |
| 5,973,272 | A | * | 10/1999 | Levillain et al. | 174/179 |
| 5,986,216 | A | * | 11/1999 | Krause | 174/179 |
| 6,031,186 | A | * | 2/2000 | Sakich et al. | 174/167 |
| 6,065,207 | A | * | 5/2000 | Fujii et al. | 29/887 |
| 2002/0158745 | A1 | * | 10/2002 | Haynam et al. | 337/171 |

* cited by examiner

*Primary Examiner*—Anatoly Vortman
(74) *Attorney, Agent, or Firm*—Dana Andrew Alden

(57) ABSTRACT

The present invention relates to an electrical fuse cutout comprising: (i) an insulator having a composite body and at least two connectors, wherein a first connector couples the composite body to a fuse assembly and a second connector couples the body to a utility structure; (ii) a housing containing the composite body; and (iii) a fuse assembly.

14 Claims, 8 Drawing Sheets

COMPOSITE INSULATOR FOR FUSE CUTOUT

FIELD OF THE INVENTION

This invention relates to fuse cutouts for electrical power distribution systems, and particularly to composite insulators used in fuse cutout devices.

BACKGROUND OF THE INVENTION

An electrical cutout is a device used to protect an electrical power distribution grid. If there is a surge in the electrical current on the line, for example, a fuse on the cutout is blown, thereby cutting off power to a section of the grid. As a result, a section of the grid loses power. Though a section of the grid experiences power loss, the entire grid is protected from the surge and remains operational.

Electrical cutouts contain three parts: a fuse, an insulator, and a fuse link. When a fuse is blown, physical force is exerted on the insulator. Consequently, the insulator must be manufactured with sufficient strength to withstand damage from the fuse when it is blown. Consequently, insulators have been made with porcelain or some other ceramic material for added strength to prevent damage when the fuse element activates. For example, U.S. Pat. No. 4,774,488 to Field, the disclosure of which Applicants hereby incorporate by reference in its entirety, teaches the use of a porcelain insulator.

The ceramic insulators, however, are heavy and bulky; they require specialized assembly fixtures or processes and are awkward and difficult to handle and ship. The ceramic insulators are also brittle and easily chipped or broken.

Problems have arisen with electrical cutouts. One such problem occurs when electricity flashes directly from a conducting surface to a grounded surface while the fuse assembly is in the open or closed position. This phenomenon is referred to as "flashover." The electricity travel gap between the conducting surface and the grounded surface is called the "strike distance."

Another problem with conventional cutouts occurs when the electrical current travels or "creeps" along the surface of the insulator, bypassing the fuse assembly. "Creep" results when the insulator has an inadequate surface distance. This may occur when water, dirt, debris, salts, air-borne material, and air pollution is trapped at the insulator surface and provide an easier path for the electrical current. This surface distance may also be referred to as the "leakage," "tracking," or "creep" distance of a cutout.

Because of these problems, cutouts must be made of many different-sized insulators. Cutouts are made with numerous insulator sizes that provide different strike and creep distances, as determined by operating voltages and environmental conditions. The strike distance in air is known, thus insulators must be made of various sizes in order to increase this distance and match the appropriate size insulator to a particular voltage. Creep distance must also be increased as voltage across the conductor increases so that flashover can be prevented.

Cutouts with plastic or polymeric insulators have been designed; however, such insulators are of complicated design and labor-intensive manufacture. Examples of such cutouts include U.S. Pat. No. 5,300,912 to Tillery et al., entitled "Electrical Cutout for High Voltage Power Lines," the disclosure of which is incorporated herein by reference. However, Tillery et al. utilizes an injection-molded insulator with a complicated non-solid cross-sectional configuration (Col. 6, ll. 20–22) with skirts mounted thereon (Col. 4, ll. 53–54).

Other insulators used in cutouts use "fins" or "sheds" which require additional time and labor for assembly. For example, U.S. Pat. No. 5,128,648 to Brandi, entitled "Line Cutout for Electrical Distribution System," the disclosure of which is hereby incorporated by reference, discloses the use of a plurality of circular "fins" (Col. 3, ll. 45–47) that are placed around a rod (FIG. 3). In U.S. Pat. No. 4,870,387 to Harmon, entitled "Beam Strengthened Cutout Insulator," the disclosure of which is incorporated herein by reference, an insulator formed of glass bead and dehydrated alumina-filled bisphenol is disclosed (see Col. 4, ll. 34–36) which utilizes "skirts" having an oval-shaped cross-sectional configuration (Col. 4, ll. 44–48).

Therefore, there exists a need for simple design that facilitates ease in the manufacture of the many different-sized cutouts and insulators the electrical power industry requires. There also exists a need for a lighter insulator that allows for greater ease in handling and shipping. Further, there exists a need for an insulator, which will not trap water, dirt, debris, salts, and air-borne material and thereby reduce the effective creep distance. Finally, there exists a need for a stronger insulator, which will not chip or break when a fuse is blown and which can withstand the tension forces exerted by electric power lines.

The present invention is directed to overcoming these and other disadvantages inherent in prior-art systems.

SUMMARY OF THE INVENTION

The scope of the present invention is defined solely by the appended claims, and is not affected to any degree by the statements within this summary. Briefly stated, an electrical fuse cutout embodying features of the present invention comprises (i) an insulator comprising, a composite body having at least two connectors; (ii) a fuse assembly, wherein a first connector couples the composite body to the fuse assembly and a second connector couples the body to a utility structure; and (iii) a housing, wherein the composite body is located inside the housing.

The present invention also comprises an insulator for an electrical fuse cutout, comprising (i) a composite body having at least two connectors, wherein a first connector couples the composite body to a fuse assembly and a second connector couples the composite body to a utility structure; and (ii) a housing, wherein the composite body is located inside the housing.

DETAILED DESCRIPTION OF THE PRESENTLY PREFERRED EMBODIMENT

Figure 1:
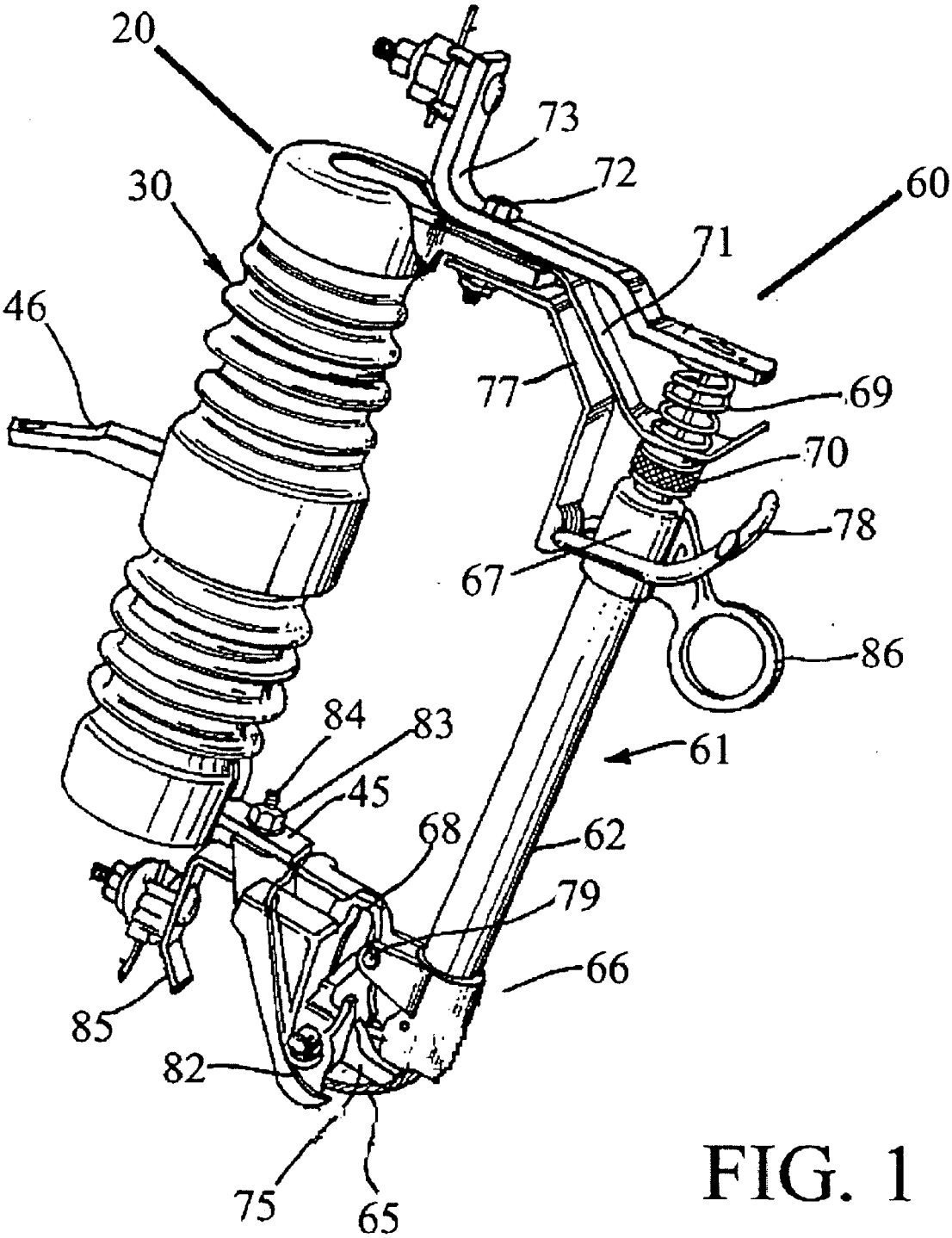
FIG. 1 depicts an embodiment of a fuse cutout.

Turning now to the drawings, FIGS. 1, 2, 3, and 4 show an electrical fuse cutout constituting a preferred embodiment of the present invention, and comprising a fuse assembly 60 and an insulator 20 having a body 30 with connectors 44, 45, 46 and a housing 50.

The preferred embodiment of the present invention is provided with end connectors 44, 45 and a support connector 46. According to one aspect of the present invention, the support connector 46 attaches the body 30 to a utility structure, such as a utility pole or, for example, a cross-arm. According to another aspect of the present invention, an end connector 44, 45 couples the body 30 to a conductor. According to yet another aspect of the present invention, an end connector 44, 45 couples the body 30 to a fuse assembly 60.

Figure 5:
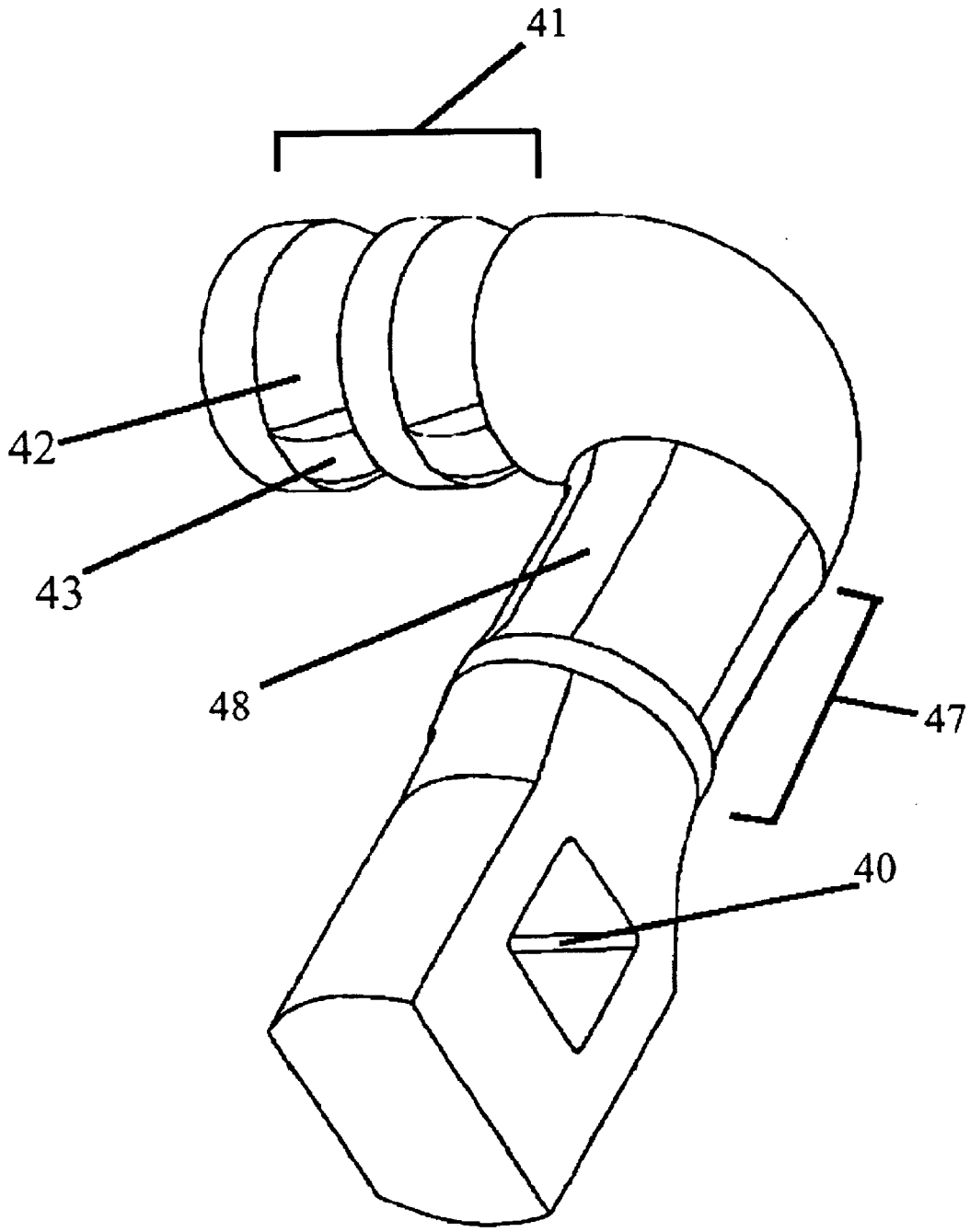
FIG. 5 depicts an embodiment of an end connector
Figure 6:
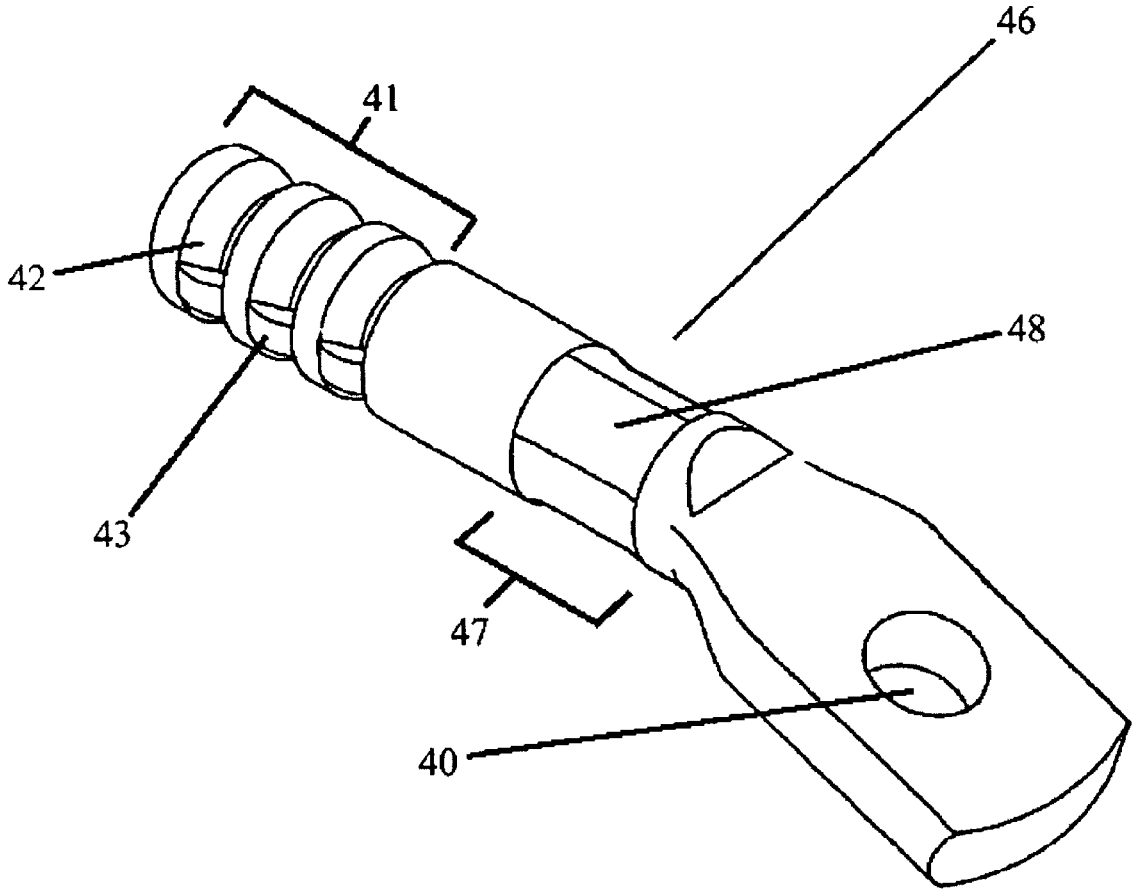
FIG. 6 depicts an embodiment of a supporting connector.

FIG. 5 depicts end connectors 44, 45 made in the shape of an "L," and, as depicted in FIG. 6, a supporting connector 46 of the preferred embodiment is angled. In the preferred embodiment of the present invention, the connectors 44, 45, 46 are formed of metal. According to one aspect of the present invention, the connectors 44, 45, 46 are steel. According to another aspect of the present invention, the connectors 44, 45, 46 are aluminum. According to yet another aspect of the present invention, the connectors 44, 45, 46 are a metal alloy. According to still another aspect of the present invention, the connectors 44, 45, 46 are made of a composite material.

In the preferred embodiment, the connectors 44, 45, 46 are formed. In one aspect of the present invention, the connectors 44, 45, 46 are forged. In another aspect, the connectors 44, 45, 46 are machined. In still another aspect of the present invention, the connectors 44, 45, 46 are cast.

The connectors 44, 45, 46 are provided with a plurality of surfaces. As illustrated in FIGS. 5 and 6, in the preferred embodiment of the present invention, at least one of the connectors 44, 45, 46 has an anchoring surface 41. The anchoring surface 41 depicted in the preferred embodiment has a conical surface 42 with a ridge surface 43. The anchoring surface 41 of the preferred embodiment allows for retention of the connector within the body 30. Furthermore, at least one of the connectors 44, 45, 46 of the preferred embodiment has a neck 47 which is formed of a plurality of flat surfaces 48. Each of the connectors 44, 45, 46 of the preferred embodiment has been manufactured with an opening 40 to accommodate a connecting structure, such as a bolt 84 as depicted in FIG. 1.

The end connectors of the present invention are not limited to the foregoing; so long as a connector serves at least the function of coupling the body 30 to a fuse assembly, it is an end connector within the scope of the present invention. Furthermore, a supporting connector 46 is not limited to the foregoing; as long as a connector serves at least the function of attaching the body 30 to a utility structure, it is a supporting connector within the scope of the present invention.

The body 30 is formed from a composite material For the present invention, a composite material is any substance in the art that has electrically insulating properties, has sufficient strength to withstand the blowing of a fuse, and is lighter per unit of volume than porcelain. The composite body of the preferred embodiment is made from materials which provide electrical insulating properties, preferably, a polymer. Other substances having electrically insulating properties may be used.

According to one aspect of the present invention, the composite material is a chemical compound, such as an organic compound, which is lighter per unit of volume than porcelain and composed of a single material. According to one aspect of the present invention, the composite material is a resin. According to another aspect of the present invention, the composite material is a polymer. According to another aspect of the present invention, the composite material is a plastic, such as thermoplastic or thermoset. According to yet another aspect of the present invention, the composite material is a polyester. According to still yet another aspect of the present invention, the composite material is an epoxy.

The composite material of the present invention is in a plurality of chemical combinations. According to one aspect of the present invention, the composite material is a mixture. According to another aspect of the present invention, the composite material is a mixture of a polymer and reinforcing materials.

The reinforcing material is in a plurality of shapes and configurations. According to one aspect of the present invention, the reinforcing material is in the shape of beads. In one embodiment, the reinforcing material is beads of glass. According to another aspect of the present invention, the reinforcing material is in a fibrous shape. In one embodiment of the present invention, the reinforcing material is glass fiber. Those skilled in the art will appreciate that the reinforcing material is composed of beads and fibers, and that any combination thereof can be used.

In one embodiment of the present invention, the reinforcing material is an insulating material such as glass. Those skilled in the art will appreciate that a composite material is a polymer mixed with glass. In another embodiment, the reinforcing material is an arimid. Those skilled in the art will also appreciate that a composite material is a polymer mixed with an aramid.

According to one aspect of the present invention, a composite material is a polymer mixed with polyester. According to another aspect of the present invention, the composite material is a polymer mixed with a resin. According to yet another aspect of the present invention, the composite material is a polymer mixed with a plastic. According to still another aspect of the present invention, the composite material is a polymer mixed with an epoxy.

The mixture is not limited to the above, and a composite material is not limited to the foregoing description. So long as the material is a substance that has electrically insulating properties, has sufficient strength to withstand the blowing of a fuse, and is lighter per unit of volume than porcelain it is a composite material within the scope of the present invention.

Figure 3:
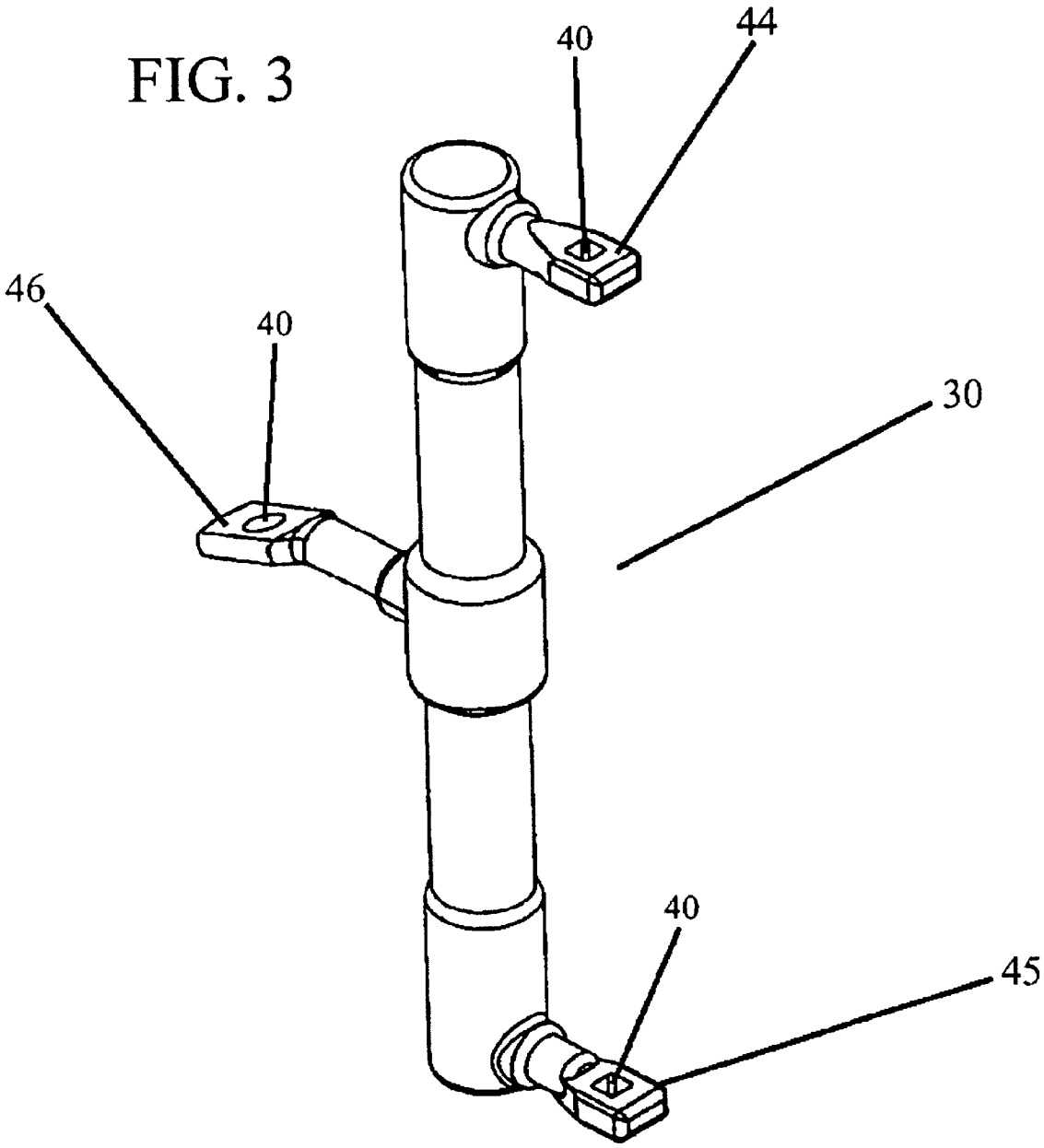
FIG. 3 depicts an embodiment of the body for an insulator for a fuse cutout.

As depicted in FIG. 3, the body 30 of the preferred embodiment is made with connectors 44, 45, 46. According to one aspect of the present invention, the body 30 is made through an injection molding process known as insert molding. The preferred embodiment is made through insert molding and the use of a mold in a plurality of pieces. According to another aspect of the present invention, the body 30 is made with connectors 44, 45, 46 through transfer molding. According to another aspect of the present invention, the body 30 is made with connectors 44, 45, 46 through compression molding. According to yet another aspect of the present invention, the body 30 is made with connectors 44, 45, 46 through casting.

The body 30 is composed of a plurality of shapes. Those skilled in the art will appreciate that the body 30 can be composed of a plurality of cylindrical shapes having a plurality of radii. According to another aspect of the present invention, the body 30 is composed of a plurality of conical shapes. Again, those skilled in the art will appreciate that the body 30 can be composed of conical shapes having a plurality of radii.

In making the body 30 of the preferred embodiment through use of a two-piece mold, the end connectors 44, 45 are placed in the mold at opposing ends. Referring now to FIG. 5, the "L" of each end connector faces the other. As depicted in FIG. 3, the supporting connector 46 is between the two end connectors 44, 45. After the connectors 44, 45, 46 are placed in the mold, the mold is closed. After the mold is closed, composite material is injected into the mold. After the composite material is injected, the mold is removed. The body 30 is then placed into the housing 50.

Figure 4:
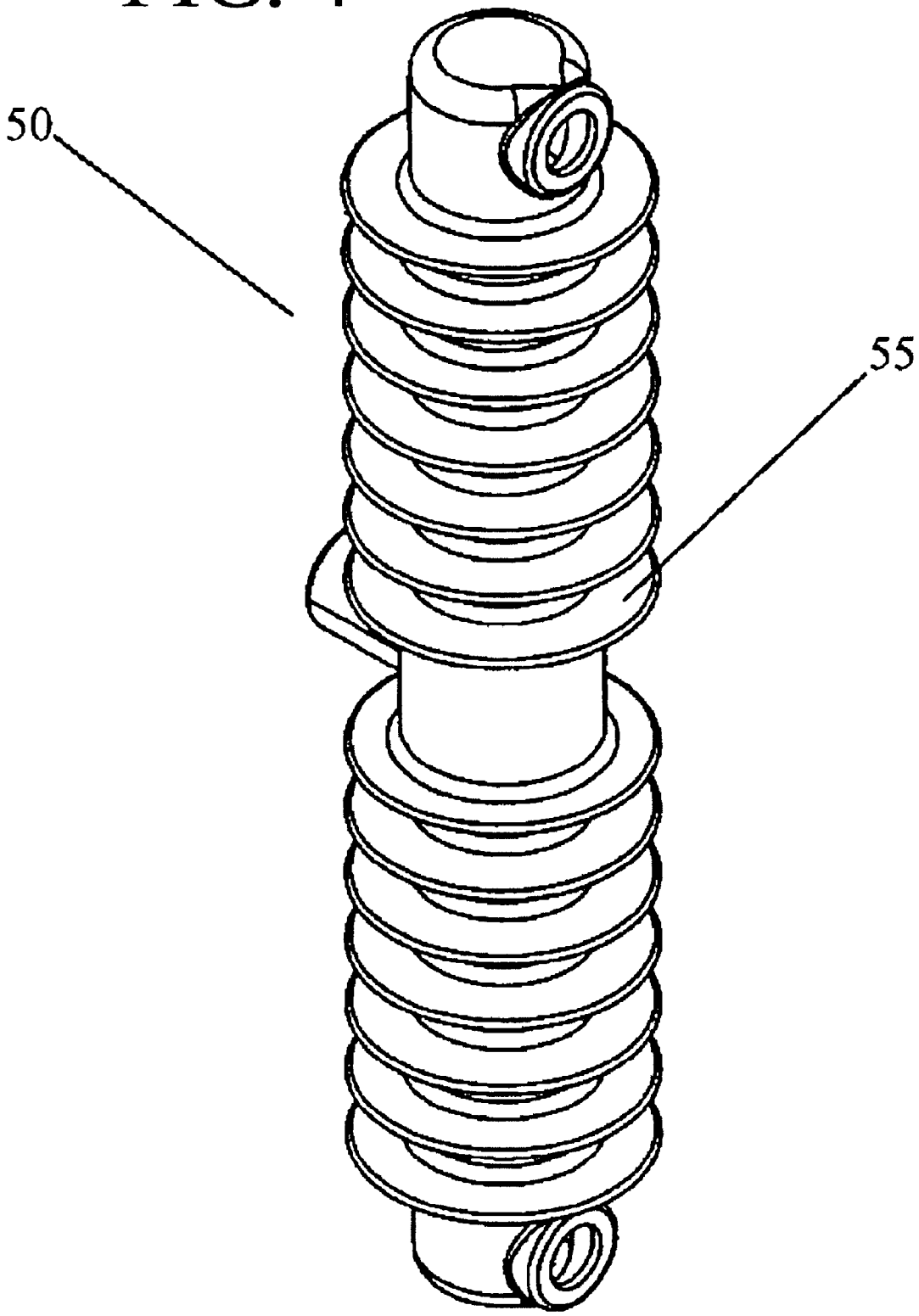
FIG. 4 depicts an embodiment of the housing for an insulator for a fuse cutout.

FIG. 4 depicts the housing 50 of the preferred embodiment of the present invention. The housing 50 of the present invention is a structure that houses the body 30. In the preferred embodiment depicted in FIG. 4, the housing 50 is made of silicone rubber. According to another aspect of the present invention, the housing 50 is made of an elastomer. According to yet another aspect of the present invention, the housing 50 is made of rubber. In another aspect of the present invention, the housing 50 is made of EPDM. In yet another aspect of the present invention, the housing 50 is made of room temperature vulcanized rubber ("RTV rubber"). According to yet another aspect of the present invention, the housing 50 is made of an alloy of rubber and elastomer materials.

The housing 50 of the preferred embodiment is made through an injection molding process known as insert molding. According to one aspect of the present invention, insert molding is accomplished through use of a mold in a plurality of pieces. According to one aspect of the present invention, the housing 50 is made through transfer molding. According to another aspect of the present invention, the housing 50 is made through compression molding. According to yet another aspect of the present invention, the housing 50 is made through casting.

Figure 2:
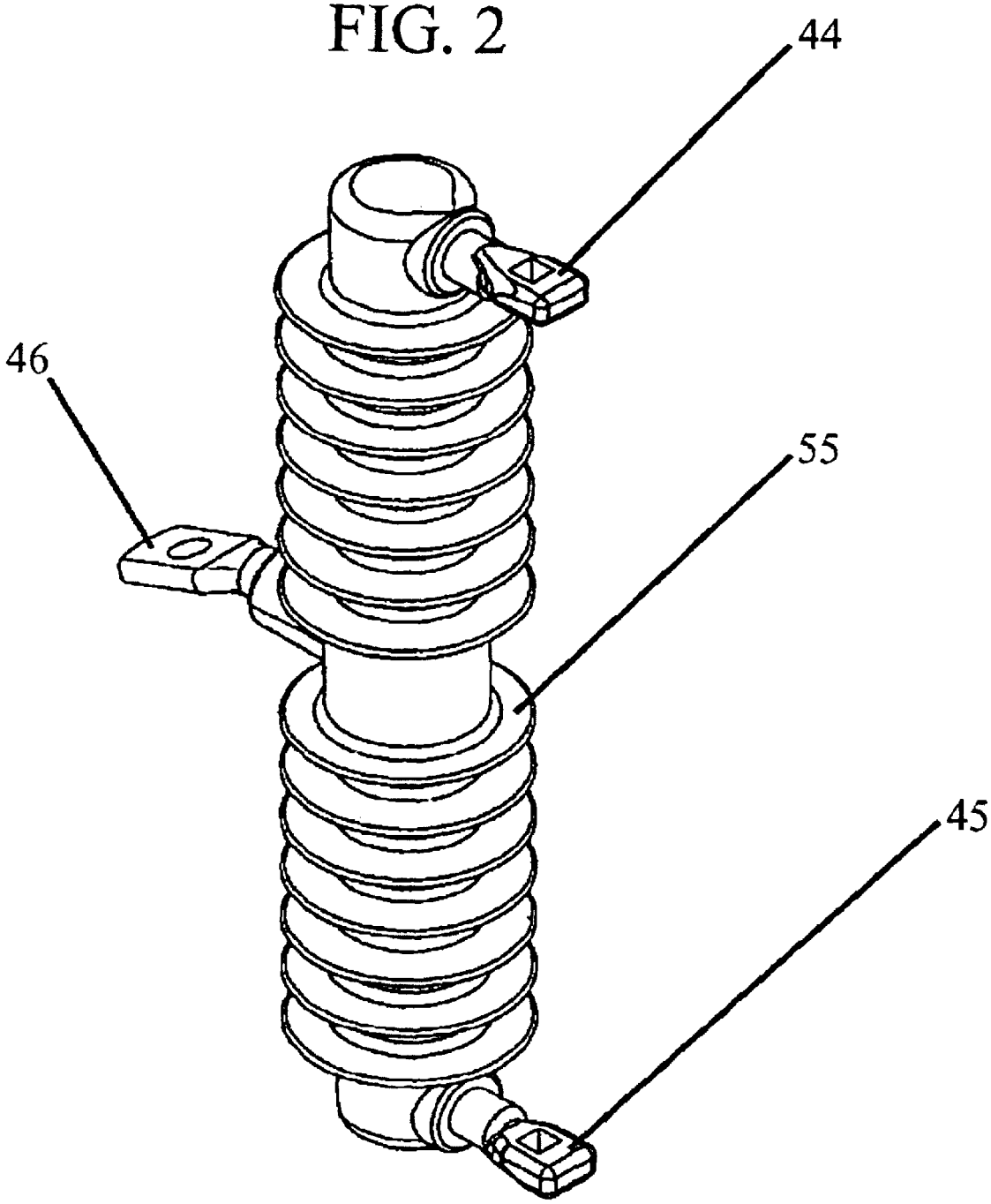
FIG. 2 depicts an embodiment of an insulator for a fuse cutout.

As depicted in FIG. 2, the body 30 is situated inside the housing 50. In the presently preferred embodiment, the housing 50 is insert-molded around the body 30. The body 30 of the preferred embodiment is inserted into a two-piece mold, which has been previously shaped with ridges; then, the mold is closed. To make the preferred embodiment depicted in FIG. 2, silicone rubber is injected into the mold so that the silicone rubber assumes the form of the housing 50 with ridges 55. In the preferred embodiment of the present invention, the ridges 55 increase the surface distance from one end of the housing 50 to the other.

While the housing 50 of the preferred embodiment is made through use of silicone rubber and a two-piece mold, other molds can be used. According to one aspect of the present invention, the mold is one piece. According to yet another aspect of the present invention, the mold is formed of a plurality of pieces. Those skilled in the art will appreciate that while the housing 50 of the preferred embodiment is formed from one mold, the housing of the present invention can be made with more than one mold.

The housing 50 of the present invention is not limited to the foregoing; so long as a structure houses the body 30, it is a housing within the scope of the present invention.

Figure 7:
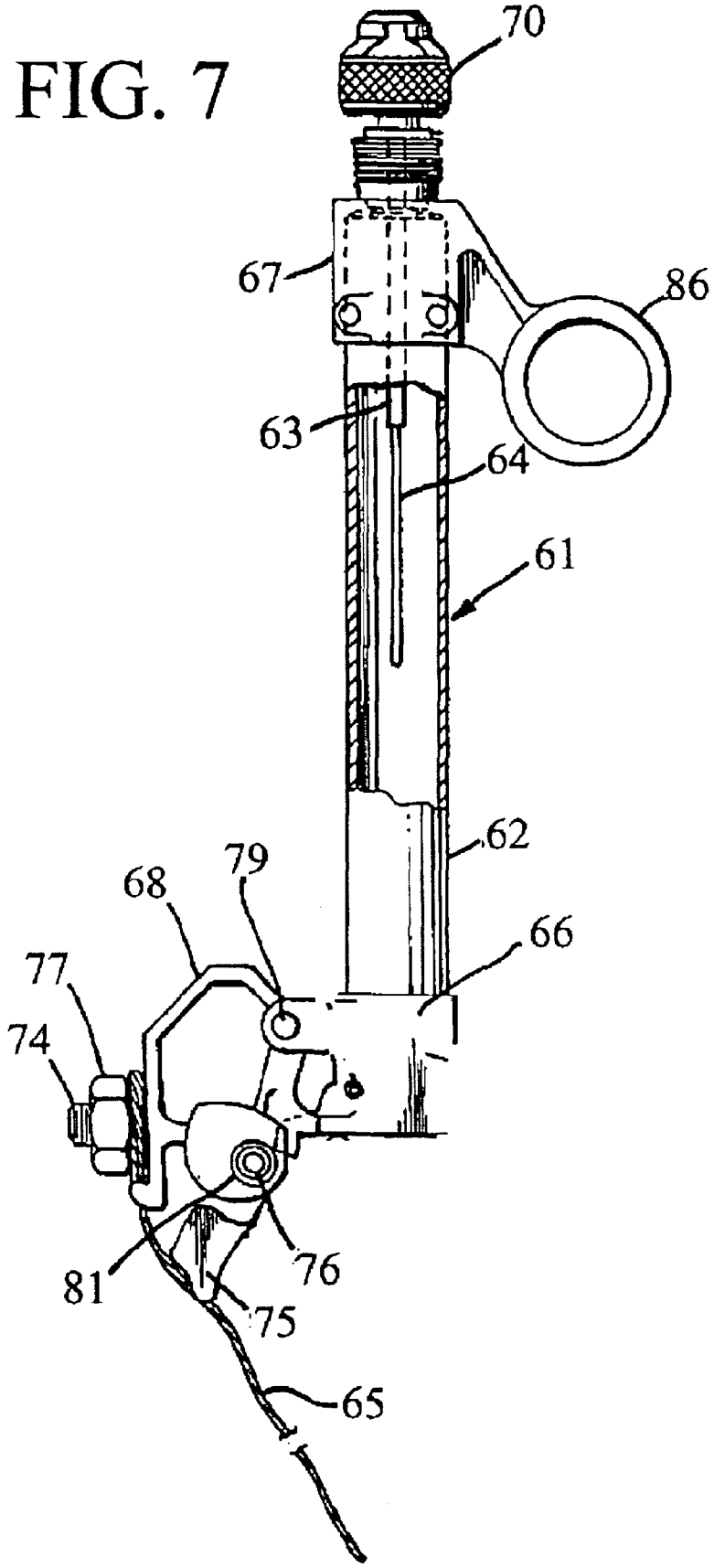
FIG. 7 depicts an embodiment of a fuse for a fuse cutout.

As depicted in FIG. 2, the present invention is provided with a fuse assembly 60. The fuse assembly includes a fuse container 61. Referring now to FIG. 7, the fuse container 61 is a hollow tube 62 formed of insulating material. The hollow tube 62 is coupled to an upper sleeve 67. The upper sleeve 67 is provided with a ring 86 and is connected to a cap 70. The cap 70 is conductively coupled to an upper conductor 71.

The upper conductor 71 is secured to an upper terminal 73 by a bolt 72. An upper spring 69 is placed between the upper terminal 73 and the upper conductor 71 so that the upper conductor 71 is held downwardly against the cap 70 by the action of the upper spring 69. The upper conductor 71 is configured so as to receive the upper end of cap 70 in conductive relationship therewith. An upper bracket 77 is also mounted to upper terminal 73 by bolt 72 and serves to support connector hooks 78.

Inside the hollow tube 62 is a rod 63. The rod 63 extends downward within the hollow tube 62 to a fuse link 64. The fuse link 64 is extends further downward within the hollow tube 62 and is connected to a lower conductor 65. The lower conductor 65 extends outwardly through the bottom end of the hollow tube 62.

The bottom end of the hollow tube 62 is secured to a lower sleeve 66. Mounted to the lower sleeve 66 via a pivot 79 is a conducting connector 68. The conducting connector 68 is pivotally connected about a shaft 76 to an ejector 75 and electrically coupled to the lower conductor 65, which extends outwardly through the bottom end of the hollow tube 62. Those skilled in the art will appreciate that the conducting connector 68 and the lower conductor 65 are coupled in a variety of ways. For example, in the presently preferred embodiment, the conducting connector 68 and the lower conductor 65 are connected through a threaded stud 74 and a nut 77. The lower conductor 65 links the ejector 75 and the conducting connector 68 by being coiled around the stud 74 and secured by the nut 76.

Figure 8:
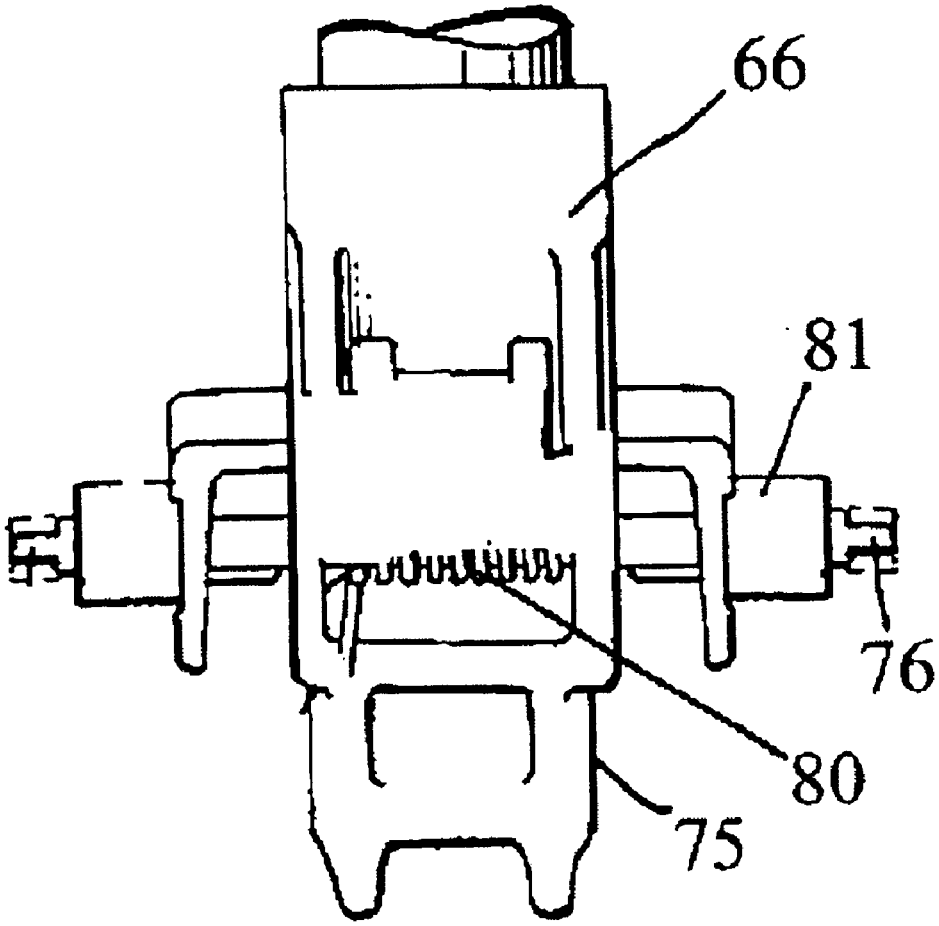
FIG. 8 depicts the frontal view of a lower sleeve for a fuse for a fuse cutout.

Referring now to FIG. 8, a lower spring 80 is anchored against the conducting connector 68 and exerts a rotating force on the ejector 75 about the shaft 76, downward from the lower sleeve 66 and the fuse container 61. When the ejector 75 is rotated in an upward direction 100 and then tension placed on the lower conductor 65, the ejector 75 is held in a position normal to the fuse container 61 and acts to support the fuse container 61 and the lower sleeve 66.

The conducting connector 68 includes trunnions 81 which are placed in a lower bracket 82. The lower bracket 82 is electrically connected to a lower terminal 85 and coupled to an end connector 44. Those skilled in the art will appreciate that the lower bracket 82 may be connected to the lower terminal 85 and to the end connector 44 in a number of ways. For example, in the preferred embodiment, the lower bracket 82 is connected to the end connector 45 and the lower terminal 85 by means of a nut 83 and bolt 84.

When a break occurs at the fuse link 64 (such as when a surge of electric power causes the fuse link to burn off), tension on the lower conductor 65 is lost. Without the tension on the lower conductor 65, the lower spring 80 rotates the ejector 75 downward from the fuse container 61. The ejector 75 assumes a position parallel to the fuse container 61 and therefore, no longer supports the fuse container 61; because the lower bracket 82 is the only support for the fuse container 61, the fuse container 61 dangles from the lower bracket 82.

To mount a fuse container 61, the trunnions 81 are placed into the lower bracket 82. After the trunnions 81 are placed into the lower bracket 82, a hook stick, known in the art, is inserted into the ring 86 so that the cap 70 can be manipulated under the upper conductor 71. The force of the upper spring 69 and the ejector 75 when it is normal to the fuse container 61 act to hold the fuse container 61 in place.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. An insulator for an electrical fuse cutout, comprising:

a) a body having at least two connectors, wherein at least a portion of at least one connector is located within the body, and wherein a first connector couples the body to a fuse assembly and a second connector couples the body to a utility structure; and b) a housing, wherein the body is located inside the housing.

2. An insulator according to claim 1, wherein the housing contains a rubber.

3. An insulator according to claim 1, wherein the body contains a polyester.

4. An insulator according to claim 1, wherein the body contains a mixture of a polyester and a glass fiber.

5. An insulator according to claim 1, wherein at least one connector has an anchoring surface.

6. An insulator according to claim 1, wherein at least one connector contains a composite material.

7. An insulator according to claim 1, wherein the housing contains a silicone rubber.

8. An insulator according to claim 1, further comprising a fuse assembly.

9. An insulator according to claim 1, wherein the body is a composite body.

10. An insulator for an electrical fuse cutout, comprising:

a) a body containing a polyester and having at least two connectors, wherein at least one connector has an anchoring surface that allows for retention of the connector within the body, and wherein a first connector couples the body to a fuse assembly and a second connector couples the body to a utility structure; and b) a housing, wherein the body is located inside the housing.

11. An insulator for an electrical fuse cutout, comprising a) a body containing a polyester and having at least two connectors, wherein at least one connector contains a composite material, and wherein a first connector couples the body to a fuse assembly and a second connector couples the body to a utility structure; and b) a housing, wherein the body is located inside the housing.

12. An insulator for an electrical fuse cutout, comprising a) a body containing a polymer and having at least two connectors containing a metal, wherein at least a portion of at least one connector is located within the body, and wherein a first connector couples the body to a fuse assembly and a second connector couples the body to a utility structure; and b) a housing containing rubber, wherein the body is located inside the housing.

13. An insulator for an electrical fuse cutout, comprising a) a body containing a polymer and having at least two connectors containing a metal, wherein at least one connector has an anchoring surface that allows for retention of the connector within the body, and wherein a first connector couples the body to a fuse assembly and a second connector couples the body to a utility structure; and b) a housing containing rubber, wherein the body is located inside the housing.

14. An insulator for an electrical fuse cutout, comprising:

a) a body containing a polymer and having at least two connectors containing a metal, wherein at least one connector contains a composite material, and wherein a first connector couples the body to a fuse assembly and a second connector couples the body to a utility structure; and b) a housing containing rubber, wherein the body is located inside the housing.

* * * * *